United States Patent [19]

Laguna

[11] Patent Number: 4,502,239

[45] Date of Patent: Mar. 5, 1985

[54] MACHINE GUN MAGAZINE LOADING

[76] Inventor: John E. Laguna, 5606 Lillie St., Fort Wayne, Ind. 46806

[21] Appl. No.: 452,936

[22] Filed: Dec. 27, 1982

[51] Int. Cl.[3] ..... F42B 39/06

[52] U.S. Cl. ..... 42/87

[58] Field of Search ..... 42/87, 88; 86/47; 89/33 D, 34; 206/3; 220/345-351; 221/103, 123, 133, 197

[56] References Cited

U.S. PATENT DOCUMENTS

| | | | |
|---|---|---|---|
| 211,691 | 1/1879 | Bennett | 42/87 |
| 719,808 | 2/1903 | Johnson | 42/87 |
| 1,192,723 | 7/1916 | Zumwalt | 42/87 |
| 1,286,810 | 12/1918 | Sheppard | 206/3 |
| 2,191,130 | 2/1940 | Ludwig | 42/49 R X |
| 2,429,745 | 10/1947 | Carlson | 221/103 |
| 2,436,154 | 2/1948 | Signalness | 42/87 |
| 2,659,173 | 11/1953 | Capito | 42/87 |
| 2,868,360 | 1/1959 | Donkin | 206/3 |
| 3,676,946 | 7/1972 | Sibilia | 42/88 X |
| 3,757,449 | 9/1973 | Schindler | 42/87 |
| 3,854,232 | 12/1974 | Musgrave | 42/87 |
| 3,887,106 | 6/1975 | Charlson et al. | 221/197 |
| 3,916,552 | 11/1975 | Pichard et al. | 42/87 |
| 3,969,980 | 7/1976 | Brandstatter et al. | 42/75 C |
| 4,009,796 | 3/1977 | Schmidt | 220/345 X |
| 4,034,644 | 7/1977 | Hupp et al. | 42/87 X |
| 4,121,365 | 10/1978 | Hodil | 42/88 |
| 4,173,211 | 11/1979 | Crawford | 42/87 X |

FOREIGN PATENT DOCUMENTS

| | | | |
|---|---|---|---|
| 752914 | 7/1956 | United Kingdom | 42/87 |

*Primary Examiner*—David H. Brown
*Assistant Examiner*—John E. Griffiths, Jr.
*Attorney, Agent, or Firm*—George A. Gust

[57] ABSTRACT

Method and apparatus for loading cartridges into a relatively large capacity firearm magazine of, for example, the rotating drum type is disclosed and includes structure defining a plurality of generally parallel extending slots for receiving cartridges in a horizontal attitude and arranged as a plurality of generally parallel, vertical columns of superposed cartridges lying in the slots. The structure also includes a sliding panel with a single cartridge-passing opening therein, which opening may be selectively aligned with any one of the cartridge columns. The cartridge-passing opening is then aligned with a magazine loading port and the cartridges transferred one at a time from the bottom of a column into the magazine. When a column is exhausted, the structure is shifted so as to align a different column with the aperture and loading port whereupon that column is transferred one at a time to the magazine. Typically, the transfer involves not only the appropriate alignment but also the rotating of the magazine in a sense opposite its normal direction of rotation during firearm operation. Refilling of the cartridge dispensing device may be facilitated by the provision of a second sliding panel so that the slot defining structure may have those slots exposed on two adjacent faces with one face juxtaposed with the panel containing the cartridge passing opening and the other face being selectively exposable for refilling the device.

8 Claims, 12 Drawing Figures

MACHINE GUN MAGAZINE LOADING

BACKGROUND OF THE INVENTION

1. Field of the Invention

The present invention relates generally to the storage and dispensing of cartridges for firearms and more particularly to a cartridge rapid transfer scheme as might be employed in the loading of cartridges into a relatively large capacity firearm magazine such as the magazine of a fully automatic firearm or so-called machine gun.

2. Description of the Prior Art

Most of the modern smaller firearms are of the breach loading variety where a cartridge is positioned at one end of and in alignment with the firearm barrel and a hammer or striker released as, for example, by pulling the trigger to strike a primer arrangement in the cartridge case base, igniting that primer and the explosive charge within the cartridge case expelling a bullet through the barrel toward a target. Upon firing such a bullet, the empty cartridge case is extracted or otherwise moved away from the barrel and a live round or fresh cartridge positioned for a subsequent shot. Such firearms may be categorized as having a manual, semi-automatic or fully automatic mode of operation. A modern bolt action rifle or revolver typifies the manual mode of operation wherein the user must not only pull the trigger to expel a bullet, but must also manipulate some further mechanism to align an unfired round with the barrel and to re-cock the hammer or primer striking mechanism prior to firing a second round. Easier and more rapid firing may be achieved with a semi-automatic mode of operation wherein either the recoil on the cartridge case or the expanding gases in the barrel are used to actuate a mechanism which expels the empty cartridge case and repositions the next cartridge for firing while re-cocking the hammer or striker mechanism. All the user need do is release the trigger and repull the trigger to fire the subsequent round. Such arrangements are commonplace in small caliber handguns, shotguns and some rifles. Even more rapid firing rates as are desirable, for example in military and related situations, may be achieved by a so-called fully automatic mode of operation wherein the recoil or expanding gases created by the discharge of one round not only expels the spent cartridge, replacing it with a new cartridge and re-cocking the firing mechanism as in the semi-automatic case, but also re-releases the firing mechanism, i.e., hammer or firing pin, discharging the subsequent cartridge so that all the user need do is hold the trigger in the pulled position and the firearm continues discharging rounds as rapidly as the mechanism inertia allows. Clearly with the high firing rate of such fully-automatic weapons, a large number of cartridges are consumed in a relatively short time and with such arrangements the firing rate is limited in one sense by the rate at which the user can reload the firearm magazine with new cartridges. One solution to this problem is, of course, to provide the user with several readily removable magazines, each already full of cartridges so that removal and replacement of the magazine effects reloading. With large, relatively complex magazine structures, this approach is not entirely satisfactory.

Numerous magazine reloading schemes have been devised including cartridge base or cartridge case gripping clips for holding a column of cartridges for insertion into a firearm magazine, however, such clips and containers are generally limited by their physical size and, particularly, length, to something on the order of thirty rounds or less. For larger capacity magazines, for example of the rotating drum type for containing an annular array of cartridges, no completely satisfactory scheme has been developed.

Illustrative of such rotating drum-type magazines is the magazine illustrated in U.S. Pat. No. 3,969,980. The machine gun therein described is commercially available in a form chambered for a conventional 0.22 caliber rim fire cartridge. The commercial version of this patent has a spring loaded, rotating drum-type magazine which holds 177 cartridges in its annular array of cartridge-accepting locations with each location receiving two or three cartridges. Each cartridge is inserted in turn by hand in loading the magazine of this illustrative patent, and a considerable length of time is required to load the magazine.

Prior art may be found in U.S. Pat. Nos. 211,691; 1,192,723; 2,191,130; 2,436,154; 2,659,173; 3,757,449; 3,854,232; 3,916,552; 3,969,980 and 4,034,644.

SUMMARY OF THE INVENTION

Among the several objects of the present invention may be noted the provision of a method of loading cartridges into a relatively large capacity firearm magazine one at a time through the cartridge-loading port thereof; the provision of an economical and rapidly operating machine gun, magazine, cartridge loader; the provision of a cartridge rapid transfer device for filling a firearm magazine; the provision of a cartridge dispenser for rapidly filling a firearm magazine which may also be used to store cartridges in a state ready for rapid transfer to a firearm magazine; and the overall increase in fully automatic firearm operation by the reduction in magazine reload time. These as well as other objects and advantageous features of the present invention will be in part apparent and in part pointed out hereinafter.

In general, an apparatus for loading the magazine includes a structure defining a plurality of generally parallel extending slots, each for receiving a laterally adjacent sequence of cartridges along with an arrangement forming a cartridge transfer path between a selected slot and a magazine loading port so that cartridges may be transferred, one at a time, from the slot to the magazine while cartridge movement from the other slots is precluded and when all cartridges have been transferred from one slot, the transfer path may be moved to another slot for the successive transfer of cartridges from each slot in turn.

Also, in one form of the invention, cartridges are loaded into a relatively large capacity magazine by arranging those cartridges horizontally in a plurality of generally parallel, vertical columns of superposed cartridges, aligning one column with a magazine loading port and shifting the columns laterally as each is exhausted to align another with the magazine loading port. In one preferred form, the magazine is of the rotating drum-type having an annular array of cartridge-accepting locations and those locations are sequentially moved past the loading port and aligned cartridge column, pausing at each location to allow a cartridge to pass from the column into the adjacent location. Typically, this moving comprises rotation of the magazine in a sense opposite its normal direction of rotation when supplying cartridges to the firearm.

BRIEF DESCRIPTION OF THE DRAWING

FIG. 7 is a longitudinal section taken substantially along section line 7—7 of FIG. 6 and with the cover in place;

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
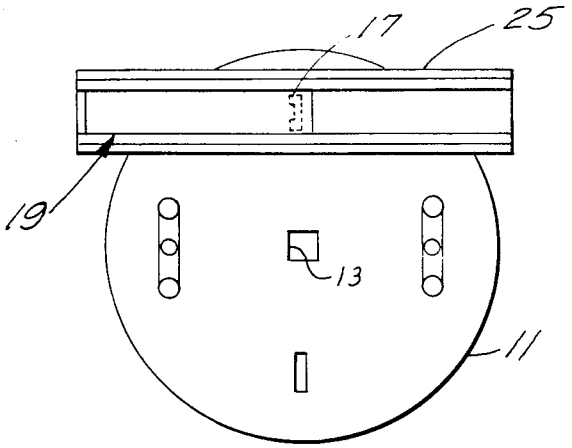
FIGS. 1, 2 and 3 are top, front and side views, respectively, of an exemplary firearm magazine mated with the one embodiment of a loading apparatus of this invention.
Figure 2:
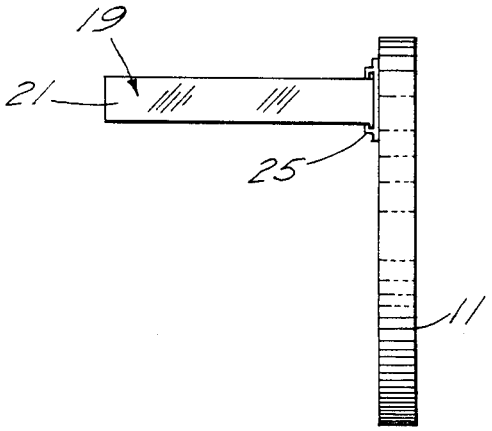
Figure 3:
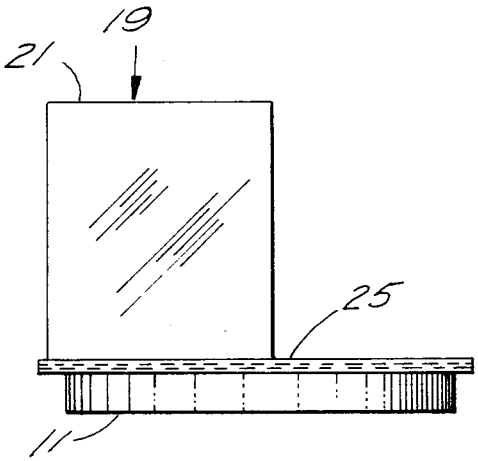

Referring first to FIGS. 1, 2 and 3, the rotating drum-type magazine 11 is, for illustrative purposes, the same as the magazine illustrated in the aforementioned U.S. Pat. No. 3,969,980. Briefly, this magazine has a relatively flat side plate which is the surface visible in FIG. 1 with the square opening 13 being adapted to fit a mating portion on the upper surface of the receiver of a machine gun. The magazine also includes an annular region of generally inverted U-shape including cartridge loading partitions of perhaps two or three cartridge diameters in depth so that the annular magazine portion holds a plurality of cartridges radially positioned with the bullet ends thereof pointing inwardly. The magazine also includes a spring loading arrangement radially inwardly of the annular portion and on the upper side of the magazine not visible in FIG. 1 for rotating the annular portion relative to the base to feed cartridges to the firearm. The magazine structure per se is more fully described in the aforementioned United States patent.

The lower plate of the magazine includes a release latch which, when the magazine is positioned on the gun, allows the spring loading to be effective to urge the annular cartridge carrying portion to rotate and feed cartridges to the firearm by way of a cartridge dispensing port at 17. This cartridge dispensing port also functions as a loading port in the present invention and absent the present invention is the opening through which cartridges are hand loaded one at a time according to the prior art techniques.

Figure 12:
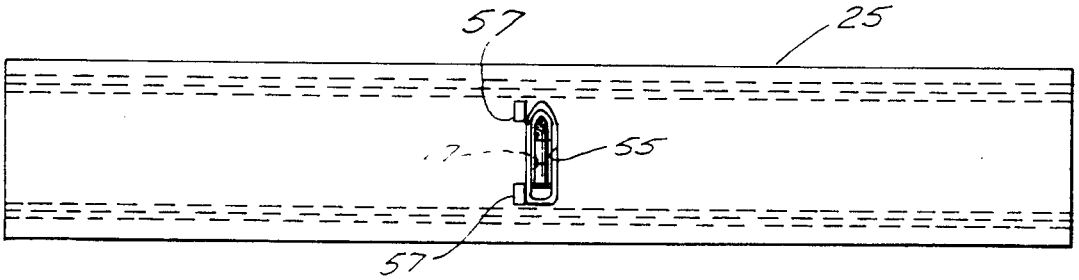
FIG. 12 is a bottom view of the apparatus with the transfer panel positioned to transfer one column of cartridges therefrom.
Figure 5:
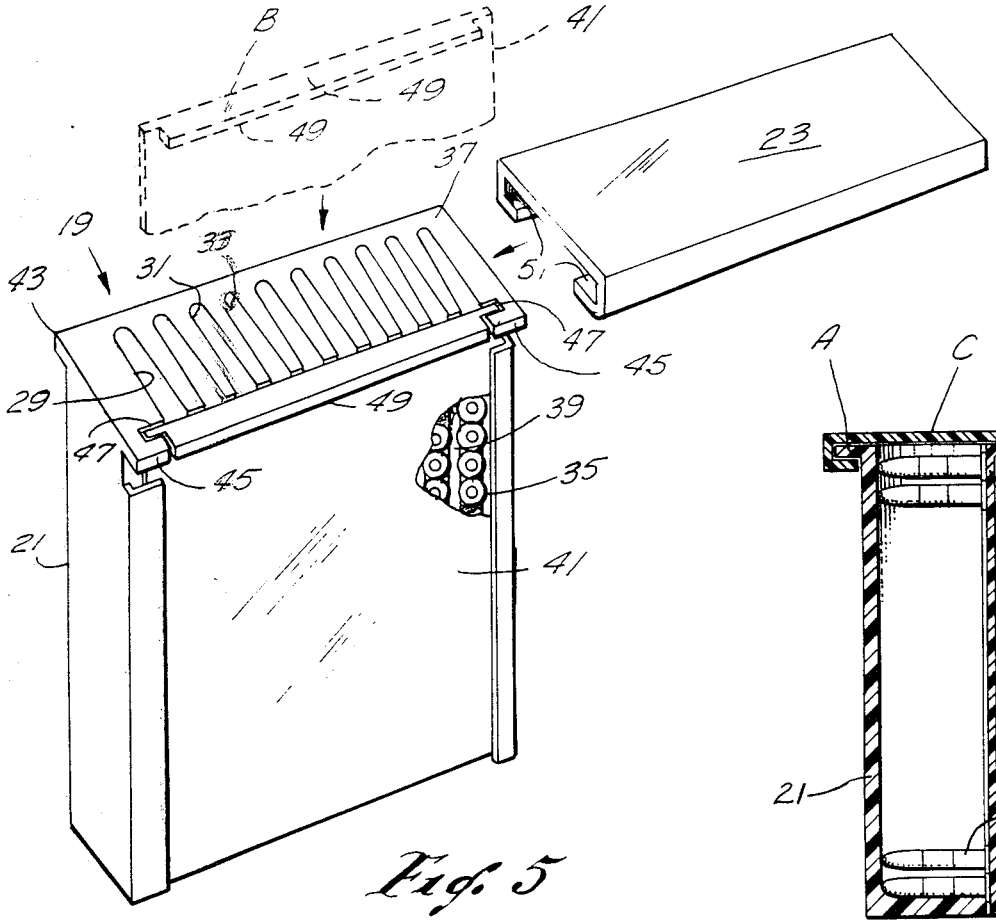
FIG. 5 is a perspective view of in exploded form of such apparatus.
Figure 1:
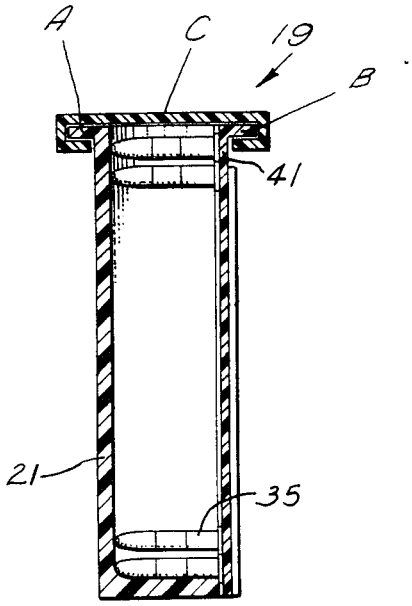
Figure 4:
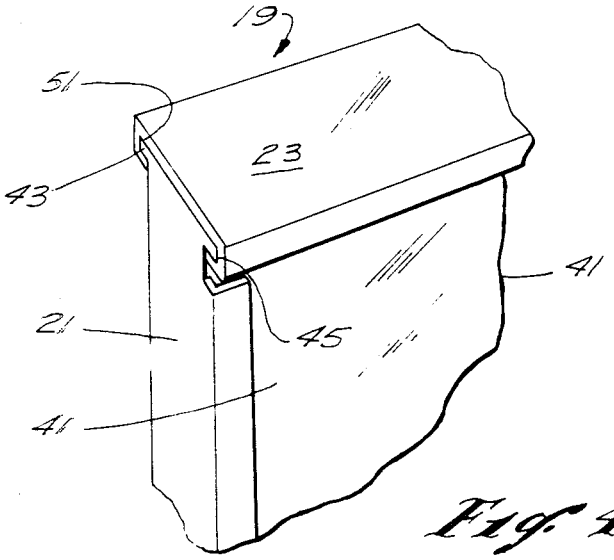
FIG. 4 is a partial perspective view of such apparatus loaded with cartridges and closed for transport.
Figure 6:
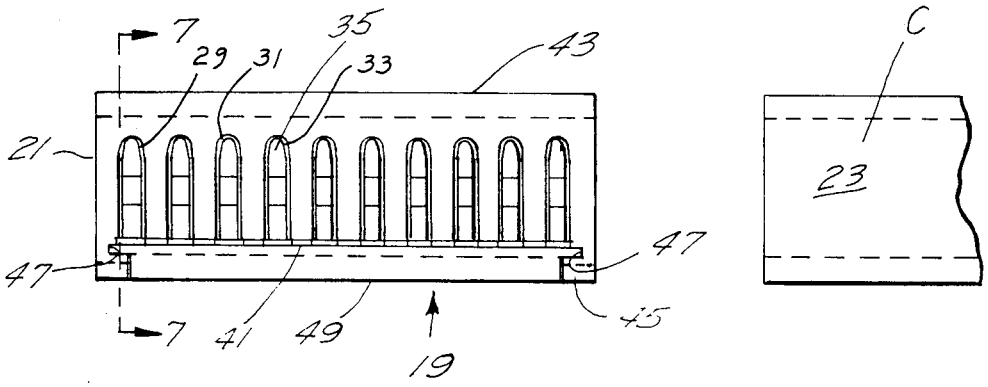
FIG. 6 is a top view of a filled apparatus with the cover removed and to one side but in line to be applied to the apparatus.
Figure 8:
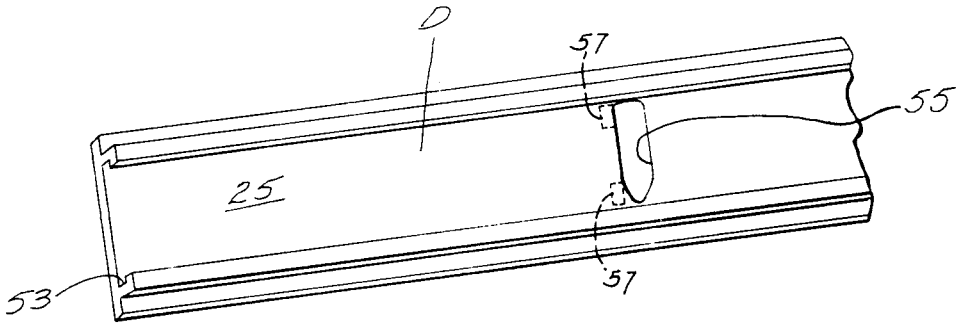
FIG. 8 is a perspective view of a cartridge transfer panel which is interchangeable with closure panel of FIGS. 4, 5 and 7.
Figure 9:
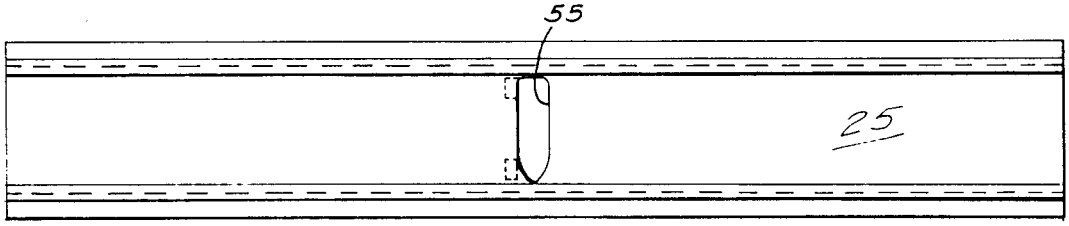
FIGS. 9, 10 and 11 are bottom, end and side views, respectively, of said transfer panel.
Figure 11:
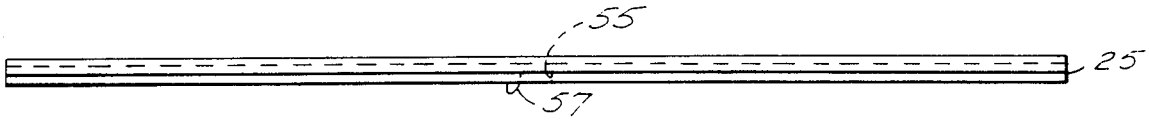
Figure 10:
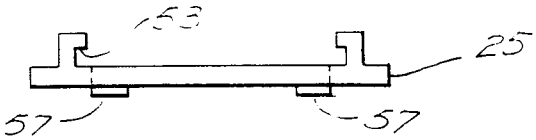

Briefly, the apparatus for loading cartridges as illustrated in FIGS. 1 through 3 generally includes a housing assembly 19 containing a slotted block 21 which may be closed at one end by a slidable cover 23 (FIGS. 4 and 5). Cover 23 is replaceable by a transfer panel 25 which is provided with a single cartridge size opening or aperture 55 (FIGS. 8, 9 and 12) aligned with the loading port 17 of the magazine so that a columnar stack of cartridges may pass one at a time through the openings 55 and 17 into the magazine as the magazine is indexed. Housing 19 and the several cartridge columns therein may be shifted laterally, as viewed in FIG. 1, relative to loading port 17, so as to sequentially align cartridge columns with the port 17. During the magazine loading process, magazine 11 is inverted from its normal operating attitude on the firearm to the position illustrated in FIG. 3 and housing 19 has its open or cover end contiguous with the magazine with the transfer panel 25 interposed therebetween.

Preparatory to the magazine loading operation, cartridges are arranged horizontally in a plurality of generally parallel, vertical columns of superposed cartridges. This arrangement is facilitated by employing the transparent plastic block 21 of FIGS. 4 through 7. This block 21 includes a plurality of generally parallel extending slots such as 29, 31, 33, etc., each for receiving a column or stack of contiguous cartridges as illustrated by the numerals 35. Block 21 may be molded of plastic in the general form of a rectangular parallelepiped with all of the slots communicating with the upper and front adjacent faces 37 and 39, respectively, as viewed in FIG. 5 while the other faces of that block do not communicate with the slots. This allows ready access to the block 21 for placing cartridges therein and thereafter the front face 39 of the block may be covered by side panel 41 (FIGS. 4 through 7).

As shown more clearly in FIGS. 4 and 5, the upper portion of the block 21 which provides the end face 37 has a laterally extending flange 43. On the opposite side, and laterally aligned but oppositely extending is another flange 45 which is in two sections of short length and so formed as to provide a groove 47 which is contiguous with the front face 39. The side panel 41 is coplanar and is adapted to be received by the groove or grooves 47 to lie flat against the face 39 thereby to engage the heads of the cartridges thereby to retain them snugly within the respective grooves 29, 31, 33, etc. The panel 41 is also provided with a laterally extending flange 49 which is coplanar with the flanges 43 and 45 when the side panel 41 is slid into place to cover fully the side face 39 of the block 21. Preferably, the groove 47 in the block 21 extends from the upper end face 37 to the lower end face of the block 21 such that when the side panel 41 is slid into position, it is firmly retained against the heads of the cartridges 35.

With the side panel 41 in place, the assembly is in readiness for receiving the end closure cover 23. This cover 23 is essentially plate-like in configuration having slots 51 which slidably fit over the coplanar flanges 43, 45, 49. When slid into position to completely cover the end face 37, the cover 23 lightly engages the end face 37 so as to close the ends of the slots 29, 31, 33, etc. The housing assembly 19 is thus completed, the slots are fully enclosed and the cartridges inserted into the slots are firmly retained in place. The housing 19 with the cartridges may thus be transported and handled freely as any object.

When it is desired to load the magazine 11 (FIGS. 1, 2 and 3) from the storage apparatus 19, the cover 23 is slid off the end face 37 and the block 21. A transfer panel 25 (FIGS. 8 through 12) is now substituted in place of the cover 23, this panel 25 being provided with a groove 53 like that in the cover 23 so that the panel 25 may be slid into position over the flanges 43, 45, 49 thereby to close the slots 29, 31, 33 in the end face 37. This panel 25 is, however, substantially longer than the cover 23 so that it may be moved in various positions on the end face 37 as will be explained. Intermediate the ends of the panel 25 is provided a transversely extending, elongated opening 55 just large enough to pass a cartridge therethrough, and immediately adjacent to one side of this opening 55 are two bosses 57 which are adapted to engage a corresponding edge of the opening 17 in the magazine 11. This then locates the opening 55 in precise registry with the opening 17.

With the panel 25 in place on the assembly of the block 21 and side panel 41, and the cartridge-passing opening 55 in registry with the magazine loading port 17, the block 21 (always with the side panel 41 in place) is moved until one of the slots 29, 31, 33, etc. is aligned with the opening 55. The particular slots 29, 31, 33, etc., selected should be the one which does not result in any of the other slots being uncovered. The cartridges in the selected slot will now drop through, one by one, the opening 55 and port 17 into the magazine 11 as the latter is incrementally rotated. Eventually, all of the cartridges in the particular slot, 29, 31, etc., will gravitate into the magazine 11, following which the block 21 is slid on the panel 25 until the next adjacent slot, slot 31 for example, will be aligned with the opening 55 and port 17. Again, the magazine 11 is incrementally rotated until all of the cartridges in that slot are fed by gravity into the magazine 11. The block 21 is once again moved, repeating the same operations just explained until the magazine 11 is fully loaded.

Now the two panels 25 and 41 may be removed from the block 21 thereby fully exposing the cartridge-receiving slots which may again be filled as before and closed in readiness to load once again the magazine 11. In this instance the closure cover 23 is fitted into place, and the transfer panel 25 is retained as a separate component to be used when it is desired to load the magazine 11.

The block 21 may be fabricated in one piece of a transparent plastic material so as to allow the user to monitor cartridge movement during loading. In order to assure proper alignment of the cartridge-passing opening 55 with the magazine loading port 17, the transfer panel 25 may be made of a magnetic material, including magnetic plastics, such that when the panel 25 is positioned flat on the cover of the magazine 11 which contains the opening 17, it will be secured in place by magnetic attraction. The cover plates on such magazines are usually of magnetic material.

From the foregoing it is now apparent that a novel ammunition dispensing apparatus and method for magazine loading meeting the objects and advantageous features set out hereinbefore as well as others have been disclosed and that modifications as to precise configurations, shapes and details may be made by those having ordinary skill in the art without departing from the spirit of the invention or the scope thereof as set out by the claims which follow.

I claim:

1. An apparatus for loading cartridges into a firearm magazine through a loading port thereof comprising:

first means formed generally as a rectangular parallele-piped defining a plurality of generally parallel extending elongated slots, each for receiving a laterally adjacent sequence of cartridges with each slot communicating with first and second adjacent faces of said first means;

second means comprising an elongated strip like panel slidingly received by the first means along the first face for forming a cartridge transfer path between one of said slots and the magazine loading port for transferring cartridges laterally one at a time from the one slot directly to the magazine while precluding cartridge movement from said slots other than the selected one slot, the first and second means being relatively moveable so that the transfer path can be successively aligned with each of said slots for the successive transfer of cartridges from each of said slots in turn; and a side panel for slidingly engaging the first means along the second face to prevent inadvertent cartridge removal while allowing ready access to the first means for placing cartridges therein.

2. The apparatus of claim 1 wherein the strip-like panel has a single elongated cartridge-passing opening near the middle thereof, the apparatus further including a removable sliding cover to be substituted for the strip-like panel during periods of non-use.

3. The apparatus of claim 1 wherein the second means can be placed in registry with the loading port and the first means thereafter moved relative to the magazine and the second means to sequentially align slots with the loading port and further comprising means for maintaining the second means in registry with the loading port.

4. The apparatus of claim 1 wherein the first means is formed of a transparent material to allow a user to monitor cartridge movement.

5. The apparatus of claim 1 wherein the first means includes slots along the second face and flanges along the first face, the flanges along the first face slidably receiving the second means and the slots along the second face slidingly receiving said panel to prevent inadvertent cartridge removal.

6. The apparatus of claim 5 wherein said side panel overlies said second face and has along one edge a laterally extending flange which is coplanar with said flanges; said second means having slots which slidably receive said flanges and said panel flange, said strip-like panel cartridge transfer path including a cartridge-passing opening registerable with any selected one of the first means slots which opens through said first face.

7. An apparatus for storing cartridges comprising a cartridge-carrying block having two flat faces that intersect, grooves on opposite sides of one of said two faces, a flat panel slidably received by said grooves in overlying relation to said one face, the other face having flanges on opposite sides thereof, said panel having a flange portion alignable with said flanges, a plurality of elongated slots in said block which are spaced apart and parallel, said slots opening through said one face and through said other face, said flat panel closing the one face openings of said slots, and an elongated closure cover having slots slidably received over said flanges in closing relation with the other face openings of said elongated slots.

8. The apparatus of claim 7 including a transfer panel shaped substantially like said closure cover and provided with like slots, said transfer panel having a cartridge-passing opening therein which is registrable with one of said other face openings.

* * * * *